US008576163B2

(12) United States Patent
Miyazaki et al.

(10) Patent No.: US 8,576,163 B2
(45) Date of Patent: Nov. 5, 2013

(54) ELECTROPHORETIC DISPLAY DEVICE, METHOD OF DRIVING THE SAME, AND ELECTRONIC APPARATUS

(75) Inventors: Atsushi Miyazaki, Suwa (JP); Mitsutoshi Miyasaka, Suwa (JP)

(73) Assignee: Seiko Epson Corporation (JP)

( * ) Notice: Subject to any disclaimer, the term of this patent is extended or adjusted under 35 U.S.C. 154(b) by 991 days.

(21) Appl. No.: 12/330,599

(22) Filed: Dec. 9, 2008

(65) Prior Publication Data

US 2009/0189849 A1 Jul. 30, 2009

(30) Foreign Application Priority Data

Jan. 25, 2008 (JP) ..... 2008-014605

(51) Int. Cl.
*G09G 3/34* (2006.01)

(52) U.S. Cl.
USPC ..... 345/107; 345/94

(58) Field of Classification Search
None
See application file for complete search history.

(56) References Cited

U.S. PATENT DOCUMENTS

| | | | | |
|---|---|---|---|---|
| 8,089,452 | B2 | 1/2012 | Kawai | |
| 2005/0078074 | A1* | 4/2005 | Morita | 345/96 |
| 2005/0285843 | A1* | 12/2005 | Yoshinaga et al. | 345/107 |
| 2006/0139309 | A1* | 6/2006 | Miyasaka | 345/107 |
| 2006/0181504 | A1* | 8/2006 | Kawai | 345/107 |
| 2006/0192751 | A1* | 8/2006 | Miyasaka et al. | 345/107 |
| 2007/0002009 | A1* | 1/2007 | Pasch et al. | 345/108 |
| 2007/0171164 | A1* | 7/2007 | Yamazaki et al. | 345/87 |
| 2007/0171187 | A1* | 7/2007 | Saito | 345/107 |
| 2007/0176869 | A1* | 8/2007 | Fujita | 345/88 |
| 2007/0222745 | A1* | 9/2007 | Kawai | 345/107 |
| 2007/0296690 | A1* | 12/2007 | Nagasaki | 345/107 |
| 2008/0266243 | A1* | 10/2008 | Johnson et al. | 345/107 |
| 2010/0149169 | A1* | 6/2010 | Miyasaka | 345/213 |

FOREIGN PATENT DOCUMENTS

| | | |
|---|---|---|
| GB | 2 444 794 | 6/2008 |
| JP | 2002-116733 | 4/2002 |
| JP | 2003-140199 | 5/2003 |
| JP | 2004-004714 | 1/2004 |
| JP | 2004-101746 | 4/2004 |
| JP | 2006-267982 | 10/2006 |
| JP | 2007-086529 | 4/2007 |
| JP | 2007-316594 | 12/2007 |

* cited by examiner

*Primary Examiner* — Joseph Haley
*Assistant Examiner* — Emily Frank
(74) *Attorney, Agent, or Firm* — Harness, Dickey & Pierce, P.L.C.

(57) ABSTRACT

A device includes: first and second substrates; an electrophoretic element between the substrates and including a dispersion medium containing electrophoretic particles; pixel electrodes on the first substrate; a common electrode opposite the pixel electrodes on the second substrate; a unit supplying an image signal having a first or second potential<the first potential to the pixel electrodes according to image data; and another unit supplying a common potential to the common electrode. The image signal is supplied in predetermined frame periods in an image signal supply period according to image data associated with the same frame image as the image data. The common potential is switched into a third potential≤the first potential and>the second potential and a fourth potential<the third potential and≥the second potential, and the switched potentials are supplied to the common electrode in the frame periods.

4 Claims, 8 Drawing Sheets

ELECTROPHORETIC DISPLAY DEVICE, METHOD OF DRIVING THE SAME, AND ELECTRONIC APPARATUS

BACKGROUND

1. Technical Field

The present invention relates to an electrophoretic display device, a method of driving the same, and an electronic apparatus.

2. Related Art

A electrophoretic display device is capable of displaying an image by generating a potential difference between pixel electrodes and a common electrode provided in a pair of substrates interposing an electrophoretic element including a dispersion medium containing electrophoretic particles and by moving the electrophoretic particles (for example, see JP-A-2002-116733, JP-A-2003-140199, JP-A-2004-004714, and JP-A-2004-101746). In such an electrophoretic display device, scanning lines used to selectively drive pixel electrodes, data lines, and pixel switching transistors are formed on a substrate of the pair of substrates which is provided with pixel electrodes formed in pixels, to perform active matrix driving (for example, see JP-A-2002-116733, JP-A-2004-004714, and JP-A-2004-101746).

However, all the electrophoretic particles do not behave in the completely same manner, even when a predetermined potential difference is generated between the pixel electrodes and the common electrode in a predetermined period such as one frame period or one horizontal scanning period. Therefore, a problem occurs in that the electrophoretic particles cannot be moved up to a desired location. Moreover, a problem occurs in that the electrophoretic particles may sink or rise due to convection currents of the dispersion medium or gravity action even when the electrophoretic particles are moved to or reach the desired location once. Therefore, an image to be displayed is not clear, a residual image occurs, or irregularity in colors or brightness between pixels occurs. That is, a technical problem occurs in that defects with a display may occur.

SUMMARY

An advantage of some aspects of the invention is that it provides an electrophoretic display device capable of displaying a high-quality image, a method of driving the electrophoretic display device, and an electronic apparatus equipped with the electrophoretic display device.

According to an aspect of the invention, there is provided an electrophoretic display device including: a pair of first and second substrates; an electrophoretic element which is interposed between the first and second substrates and includes a dispersion medium containing electrophoretic particles; a plurality of pixel electrodes which are formed on the first substrate; a common electrode which is formed opposite the plurality of pixel electrodes on the second substrate; an image signal supply unit which supplies an image signal having a first potential or a second potential lower than the first potential to the plurality of pixel electrodes in accordance with image data; and a common potential supply unit which supplies a common potential to the common electrode. The image signal supply unit supplies the image signal to the plurality of pixel electrodes in each of a predetermined number of frame periods in an image signal supply period containing the predetermined number of frame periods in accordance with the image data associated with the same frame image as the image data. In addition, the common potential supply unit switches the common potential into a third potential equal to or lower than the first potential and higher than the second potential and a fourth potential lower than the third potential and equal to or higher than the second potential, and supplies the switched potentials to the common electrode in each of the frame periods in the image signal supply period.

In the electrophoretic display device according to the aspect of the invention, one pair of the first substrate and the second substrate are disposed so as to be opposed to each other with the electrophoretic element interposed therebetween. On a side of the first substrate opposed to the second substrate, the plurality of pixel electrodes are arranged in a matrix shape in correspondence to intersections of the data lines and the scanning lines which intersect each other on the first substrate, for example. On the first substrate, for example, the transistors as the pixel switching elements, which are provided in the pixels provided with the plurality of pixel electrodes, are capable of performing active matrix driving. On the other hand, on a side of the second substrate opposed to the first substrate, the common electrode is provided in a solid state, for example, so as to be opposed to the plurality of pixel electrodes. The electrophoretic element includes the dispersion medium containing the electrophoretic particles (for example, a plurality of white particles charged to a negative polarity and a plurality of black particles charged to a positive polarity).

In operation of the electrophoretic display device according to the aspect of the invention, an image is displayed on the display unit including the plurality of pixels by applying voltage (that is, a potential difference) according to the image signal to the electrophoretic element interposed between the pixel electrodes and the common electrode. More specifically, on the basis of the voltage applied between the pixel electrodes and the common electrode, one of each white particle charged to the negative polarity and each black particle charged to the positive polarity is moved (that is, migrated) toward the pixel electrode in the dispersion medium and the other thereof is moved toward the common electrode in the dispersion medium. In this way, an image is displayed on a side of the second substrate in which the common electrode is formed. At this time, the image signal supply unit supplies the image signal having the first potential or the second potential lower than the first potential in accordance with image data to the pixel electrodes through the transistors as the pixel switching elements selected (that is, turned ON) upon supplying the scanning signal through the data lines and the scanning lines. On the other hand, the common potential supply unit supplies the common potential to the common electrode.

In particular, the image signal supply unit supplies the image signal to the plurality of pixel electrodes in accordance with the image data associated with the same frame image as the image data in each of the predetermined number of frame periods in the image signal supply period containing the predetermined number of frame periods. Moreover, the common potential supply unit switches the common potential into the third potential and the fourth potential lower than the third potential in each of the frame periods in the image signal supply period and supplies the switched potentials to the common electrode. Here, "the image signal supply period" refers to a period in which the image signal according to the image data associated with a frame image, which is an image for one screen to be displayed, is supplied to the pixel electrodes. For example, the image signal supply period is set as a period of ten times of the frame period. "The frame period" is a unit period in which the frame image is displayed and a vertical scanning period (also referred to as one vertical period or one V period) which is set in advance in order to select all the plurality of scanning lines in a predetermined order, for example. The third potential is generally the same potential as the first potential and the fourth potential is generally the same potential as the second potential.

In a first frame period in the image signal supply period containing the first frame period, a second frame period, . . . , and an n-th frame period (where n is a natural number) in this order, the fourth potential (which is generally the same potential as the second potential) as the common potential is supplied to the common electrode. In addition, voltage is applied between the common electrode and the pixel electrodes to which the image signal having the first potential is supplied, and voltage is not applied between the common electrode and the pixel electrodes to which the image signal having the second potential is supplied. In the second frame period followed after the first frame period, the third potential (which is generally the same potential as the first potential) as the common potential is supplied to the common electrode. In addition, no voltage is applied between the common electrode and the pixel electrodes to which the image signal having the first potential is supplied, and voltage is applied between the common electrode and the pixel electrodes to which the image signal having the second potential is supplied. In the third frame period followed after the second frame period, like the first frame period, the fourth potential as the common potential is supplied to the common electrode. In addition, voltage is applied between the common electrode and the pixel electrodes to which the image signal having the first potential is supplied, and no voltage is applied between the common electrode and the pixel electrodes to which the image signal having the second potential is supplied. In the fourth frame period followed after the third frame period, like the second frame period, voltage is applied or not applied between the common electrode and the pixel electrodes. In this way, in the odd-numbered frame period, the fourth potential as the common potential is supplied to the common electrode. In addition, voltage is applied between the common electrode and the pixel electrodes to which the image signal having the first potential is supplied, and no voltage is applied between the common electrode and the pixel electrodes to which the image signal having the second potential is supplied. On the other hand, in the even-numbered frame period, the third potential as the common potential is supplied to the common electrode. In addition, no voltage is applied between the common electrode and the pixel electrodes to which the image signal having the first potential is supplied, and voltage is applied between the common electrode and the pixel electrodes to which the image signal having the second potential is supplied.

That is, in each of the frame periods in the image signal supply period, the voltage according to the image signal is alternatively applied between the common electrode and the pixel electrodes to which the image signal having the second potential is supplied and between the common electrode and the pixel electrodes to which the image signal having the first potential is supplied.

Accordingly, it is possible to surely move the electrophoretic particles between the common electrode and the pixel electrodes. That is, one of each white particle charged to the negative polarity and each black particle charged to the positive polarity is surely moved toward to the pixel electrode in the dispersion medium and the other thereof is surely moved toward to the common electrode in the dispersion medium.

In particular, since in the image signal supply period, the voltage according to the image signal corresponding to the image data associated with the same frame image is applied repeatedly several times between the common electrode and the pixel electrodes in a unit of the frame period, it is possible to surely attract the electrophoretic particles toward the common electrode and the pixel electrodes while preventing the electrophoretic particles from sinking and rising due to the convection currents of the dispersion medium and the gravity action. Accordingly, it is possible to improve the contrast of an image to be displayed.

As a result, in the electrophoretic display device according to the aspect of the invention, it is possible to display a high-quality clear image while reducing a residual image or irregularity in color or brightness between pixels, for example.

In the electrophoretic display device according to the aspect of the invention, the third potential may be lower than the first potential and the fourth potential may be higher than the second potential.

According to the aspect of the invention, the electrophoretic particles can be surely moved toward the electrodes to be moved between the pixel electrodes and the common electrode.

For example, when the first potential and the second potential are set to 15 V and 0 V, respectively, the third potential and the fourth potential may be set to 14.5 V and 0.5 V, respectively. A difference between the first potential and the third potential and a difference between the second potential and the fourth potential may be set as small as possible within ranges in which the first potential is not lower than the third potential and the second potential is not higher than the fourth potential even due to the image signal variation in the common potential.

The electrophoretic display device according to the aspect of the invention may further include: on the first substrate, data lines and scanning lines which intersect one another; transistors which are formed in correspondence to intersection of the data lines and the scanning lines and electrically connected to the pixel electrodes; and retention capacitors which are electrically connected between the transistors and the pixel electrodes and temporarily hold the image signal. In addition, the image signal supply unit supplies the image signal to the pixel electrodes through the data lines and the scanning lines.

According to the electrophoretic display device, active matrix driving is possible. Here, the image signal in the pixel electrode is maintained only for some time by the retention capacitors temporarily holding the image signal supplied through the data lines and the transistors. Accordingly, it is possible to further improve the contrast of an image to be displayed.

According to another aspect of the invention, there is provided a method of driving an electrophoretic display device including a pair of first and second substrates, an electrophoretic element which is interposed between the first and second substrates and includes a dispersion medium containing electrophoretic particles, a plurality of pixel electrodes which are formed on the first substrate, a common electrode which is formed opposite the plurality of pixel electrodes on the second substrate, an image signal supply unit which supplies an image signal having a first potential or a second potential lower than the first potential to the plurality of pixel electrodes in accordance with image data, and a common potential supply unit which supplies a common potential to the common electrode. The method includes: supplying the image signal to the plurality of pixel electrodes in accordance with image data associated with the same frame image as the image data in each of a predetermined number of frame periods in an image signal supply period containing the predetermined number of frame periods by the image signal supply unit; and switching the common potential into a third potential equal to or lower than the first potential and higher than the second potential and a fourth potential lower than the third potential and equal to or higher than the second potential, and supplying the switched potentials to the common electrode in each of the frame periods in the image signal supply period by the common potential supply unit.

According to the method of driving the electrophoretic display device according to the another aspect of the invention, like the electrophoretic display device described above, it is possible to surely move the electrophoretic particles between the common electrode and the pixel electrodes. Moreover, it is possible to surely attract the electrophoretic particles toward the common electrode and the pixel electrodes while preventing the electrophoretic particles from sinking and rising due to the convection currents of the dispersion medium and the gravity action. As a result, the high-quality image can be displayed.

Even in the method of driving the electrophoretic display device according to another aspect of the invention, the electrophoretic display device described above according to the aspect of invention can be adopted.

According to still another aspect of the invention, there is provided an electronic apparatus including the electrophoretic display device having the above-described configuration.

Since the electronic apparatus includes the electrophoretic display device described above, it is possible to realize various electronic apparatus such as a wrist watch, an electronic paper, an electronic note, a cellular phone, a portable audio apparatus capable of displaying a high-quality image.

Operations and other advantages of the invention are apparent from exemplary embodiments described below.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to the drawings.

First Embodiment

An electrophoretic display device will be described with reference to FIG. 1 to FIG. 6 and FIGS. 7A to 7D according to a first embodiment.

First, an overall configuration of the electrophoretic display device will be described with reference to FIGS. 1 to 2 according to this embodiment.

Figure 1:
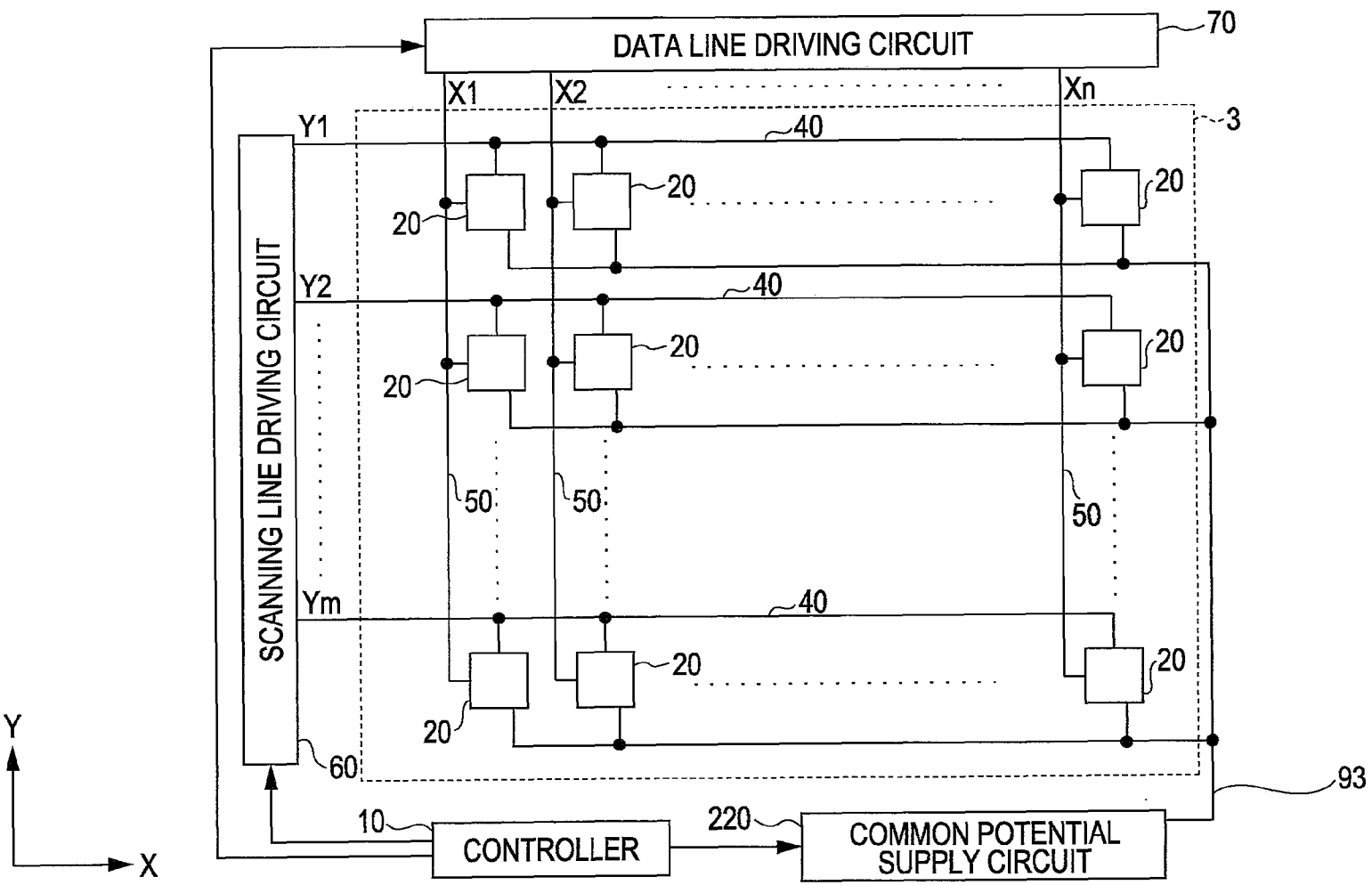
FIG. 1 is a block diagram illustrating an overall configuration of an electrophoretic display device according to a first embodiment.

FIG. 1 is a block diagram illustrating the overall configuration of the electrophoretic display device according to this embodiment.

According to this embodiment, as shown in FIG. 1, an electrophoretic display device 1 includes a display unit 3, a controller 10, a scanning line driving circuit 60, a data line driving circuit 70, and a common potential supply circuit 220.

In the display unit 3, pixels 20 arranged in m rows by n columns are formed in a matrix shape (two-dimensional surface). In addition, m scanning lines 40 (that is, scanning lines Y1, Y2, . . . , and Ym) and n data lines 50 (that is, data lines X1, X2, . . . , and Xn) intersect each other in the display unit 3. Specifically, the m scanning lines 40 extend in a row direction (that is, an X direction) and the n data lines 50 extend in a column direction (that is, a Y direction). The pixels 20 are disposed in correspondence to locations where the m scanning lines 40 and the n data lines 50 intersect each other.

The controller 10 controls operations of the scanning line driving circuit 60, the data line driving circuit 70, and the common potential supply circuit 220. For example, the controller 10 supplies a clock signal and a timing signal such as a start pulse to the circuits. In addition, the controller 10 is included by an example of "an image signal supply unit" related to the invention in addition to the scanning line driving circuit 60 and the data line driving circuit 70 described below and constitutes "a common potential supply unit" related to the invention in addition to the common potential supply circuit 220 described below.

The scanning line driving circuit 60 supplies a pulse scanning signal sequentially to the scanning lines Y1, Y2, . . . , and Ym on the timing signal supplied from the controller 10.

The data line driving circuit 70 supplies an image signal to the data lines X1, X2, . . . , and Xn on the basis of the timing signal supplied from the controller 10. The image signal takes a binary potential of a high potential VH (for example, 15 V) or a low potential VL (for example, 0 V). In this embodiment, the image signal having the low potential VL is supplied to the pixels 20 to be displayed with a black color and the image signal having the high potential VH is supplied to the pixels 20 to be displayed with a white color.

In this embodiment, in a reset period before an image signal supply period in which the image signal is supplied to the pixels 20, the scanning line driving circuit 60 supplies the high potential VH all the m scanning lines 40 and the data line driving circuit 70 supplies the low potential VL to all the n data lines 50, as described below.

The common potential supply circuit 220 supplies a common potential Vcom to common potential lines 93.

Various signals are input to and output from the controller 10, the scanning line driving circuit 60, the data line driving circuit 70, and the common potential supply circuit 220, but signals which are not related to this embodiment will not be described.

Figure 2:
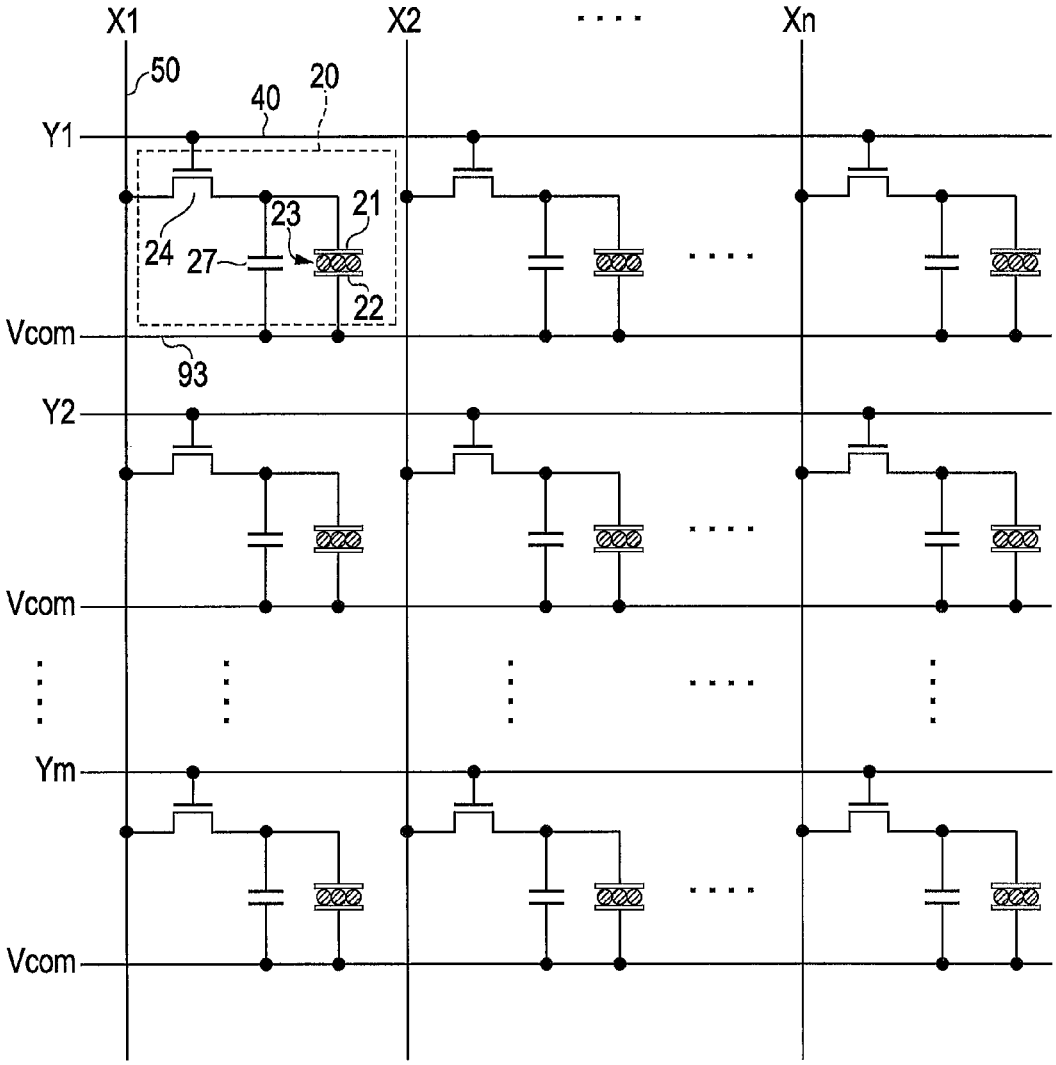
FIG. 2 is an equivalent circuit diagram illustrating an electric configuration of pixels of the electrophoretic display device according to the first embodiment.

FIG. 2 is an equivalent circuit diagram illustrating an electric configuration of the pixels.

In FIG. 2, each of the pixels 20 includes a pixel switching transistor 24, a pixel electrode 21, a common electrode 22, an electrophoretic element 23, and a retention capacitor 27.

The pixel switching transistor 24 is formed of an N-type transistor, for example. In the pixel switching transistor 24, a gate is electrically connected to the scanning line 40, a source is electrically connected to the data line 50, and a drain is electrically connected to the pixel electrode 21 and the retention capacitor 27. The pixel switching transistor 24 outputs the image signal supplied from the data line driving circuit 70 (see FIG. 1) through the data line 50 to the pixel electrode 21 and the retention capacitor 27 at timing according to a pulse scanning signal supplied from the scanning line driving circuit 60 through the scanning line 40 (see FIG. 1).

The image signal is supplied from the data line driving circuit 70 to the pixel electrodes 21 through the data lines 50 and the pixel switching transistors 24. The pixel electrodes 21 are disposed opposite the common electrode 22 with the electrophoretic element 23 interposed therebetween.

The common electrode 22 is electrically connected to the common potential lines 93 to which the common potential Vcom is supplied.

The electrophoretic element 23 includes a plurality of micro capsules which each contain the electrophoretic particles.

The retention capacitor 27 is constituted by a pair of electrodes disposed opposite to each other through a dielectric film. One electrode of the retention capacitor 27 is electrically connected to the pixel electrode 21 and the pixel switching transistor 24 and the other electrode thereof is electrically connected to the common potential line 93. The retention capacitor 27 holds the image signal for some time.

Next, a detailed configuration of the display unit of the electrophoretic display device will be described with reference to FIGS. 3 and 4 according to this embodiment.

Figure 3:
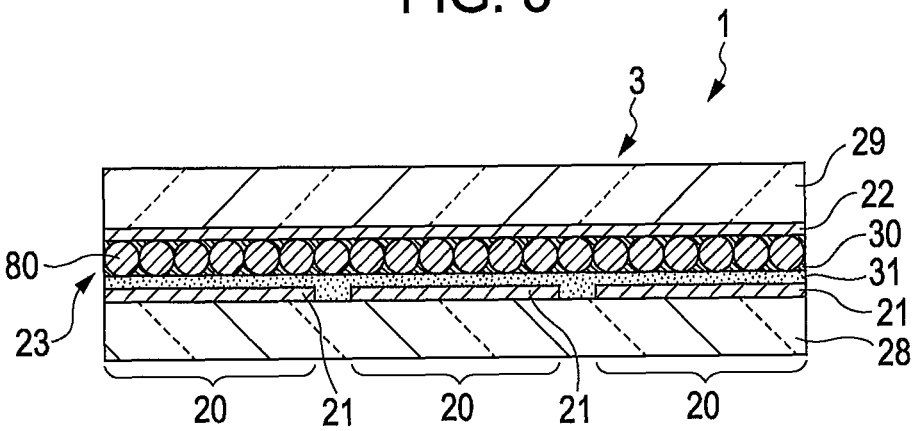
FIG. 3 is a partial sectional view illustrating a display unit of the electrophoretic display device according to the first embodiment.

FIG. 3 is a partial sectional view illustrating the display unit of the electrophoretic display device according to this embodiment.

In FIG. 3, the display unit 3 has a configuration in which the electrophoretic element 23 is interposed between an element substrate 28 and a counter substrate 29. This embodiment will be described on the assumption that an image is displayed on a side of the counter substrate 29. The element substrate 28 is an example of "a first substrate" according to the invention and the counter substrate 29 is an example of "a second substrate" according to the invention.

The element substrate 28 is formed of glass or plastic, for example. On the element substrate 28, even through not shown, a laminated structure is formed in which the pixel switching transistors 24, the retention capacitors 27, the scanning lines 40, the data lines 50, the common potential lines 93, and the like described above with reference to FIG. 2 are laminated. On upper side of the laminated structure, the plurality of pixel electrodes 21 are arranged in a matrix shape.

The counter substrate 29 is a transparent substrate formed of glass or plastic, for example. The common electrode 22 in a solid state is formed opposite the plurality of pixel electrodes 9*a* on the plane of the counter substrate 29 opposite the element substrate 28. The common electrode 22 is formed of a transparent conductive material such as silver magnesium (MgAg), indium tin oxide (ITO), indium zinc oxide (IZO).

The electrophoretic element 23 includes the plurality of micro capsules 80 containing the electrophoretic particles. The electrophoretic element 23 is fixed between the element substrate 28 and the counter substrate 29 by a binder 30 formed of a resin or the like and an adhesive layer 31. In the electrophoretic display device 1 according to this embodiment, an electrophoretic sheet formed by fixing the electrophoretic element 23 to the counter substrate 29 by the binder 30 in advance is attached to the separately manufactured element substrate 28 provided with the pixel electrodes 21 by the adhesive layer 31.

The micro capsules 80 are interposed between the pixel electrodes 21 and the common electrode 22. In addition, one or the plurality of micro capsules 80 are disposed within one pixel 20 (in other words, for one pixel electrode 21).

Figure 4:
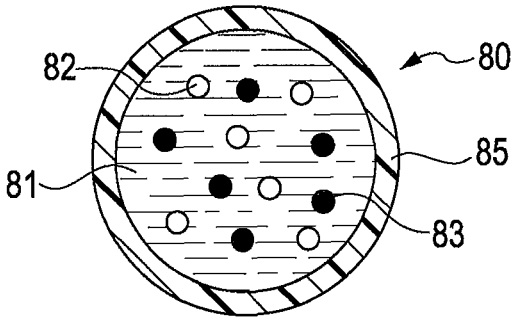
FIG. 4 is a schematic diagram illustrating the configuration of a micro capsule.

FIG. 4 is a schematic diagram illustrating the configuration of the micro capsule. The cross section of the micro capsule is schematically shown in FIG. 4.

In FIG. 4, the micro capsule 80 includes a dispersion medium 81, a plurality of white particles 82, and a plurality of black particles 83 within a coat membrane 85. The micro capsule 80 has a spherical shape with a particle diameter of about 50 μm, for example. The white particles 82 and the black particles 83 are examples of "electrophoretic particles" of the invention.

The coat membrane 85 functions as an outer shell of the micro capsule 80 formed of transparent polymer resin such as acryl resin such as polymethyl methacrylate and polyethyl methacrylate, urea resin, gum Arabic, and gelatine.

The dispersion medium 81 is a medium for dispersing the white particles 82 and the black particles 83 in the micro capsule 80 (in the words, the coat membrane 85). Examples of the dispersion medium 81 include water, alcoholic solvent (such as methanol, ethanol, isopropanol, butanol, octanol, and methyl cellosolve), esters (such as ethyl acetate and butyl acetate), ketones (such as acetone, methylethyl ketone, and methyl isobutyl ketone), aliphatic hydrocarbons (such as pentane, hexane, and octane), alicyclic hydrocarbons (such as cyclohexane and methyl cyclohexane), aromatic hydrocarbons (such as benzene, toluene, and benzenes having a long-chain alkyl group (such as xylene, hexyl benzene, heptyl benzene, octyl benzene, nonyl benzene, decyl benzene, undecyl benzene, dodecyl benzene, tridecyl benzene, and tetradecyl benzene)), halogenated hydrocarbon (such as methylene chloride, chloroform, carbon tetrachloride, and 1,2-dichloroethane), carboxylate salt, and other oil substances. These materials may be used singly or as a mixture. The dispersion medium 81 may be mixed with surfactant.

The white particles 82 are particles (polymer or colloid) formed of white pigments such as titanium dioxide, zinc flower, and antimony trioxide and are charged to, for example, negative polarity.

The black particles 83 are particles (polymer or colloid) formed of black pigments such as aniline black and carbon black and are charged to, for example, positive polarity.

Accordingly, the white particles 82 and the black particles 83 moves in the dispersion medium 81 thanks to an electric field generated by a potential difference between the pixel electrodes 21 and the common electrode 22.

A charging control agent including particles of electrolyte, surfactant, metal soap, resin, rubber, oil, varnish, or compound, a dispersion solvent such as titanium coupling agent, aluminum coupling agent, and silane coupling agent, lubricant, and stabilizer may be added to the pigments as needed.

In FIGS. 3 and 4, when voltage is applied between the pixel electrodes 21 and the common electrode 22 so that the potential of the common electrode 22 is relatively higher, the black particles 83 charged to the positive polarity are attracted toward the pixel electrodes 21 within the micro capsules 80 by the Coulomb force and the white particles 82 charged to the negative polarity are attracted toward the common electrode 22 within the micro capsules 80 by the Coulomb force. As a result, the white particles 82 are gathered on a side of a display surface (that is, a side of the common electrode 22) within the micro capsules 80 to display a color (that is, a white color) of the white particles 82 on the display surface of the display unit 3. Conversely, when voltage is applied between the pixel electrodes 21 and the common electrode 22 so that the potential of the pixel electrodes 21 is relatively higher, the white particles 82 charged to the negative polarity are attracted toward the pixel electrodes 21 by the Coulomb force and the black particles 83 charged to the positive polarity are attracted toward the common electrode 22 by the Coulomb force. As a result, the black particles 83 are gathered on a side of the display surface within the micro capsules 80 to display a color (that is, a black color) of the black particles 83 on the display surface of the display unit 3.

Red, green, and blue colors can be displayed by replacing the pigments used for the white particles 82 and the black particles 83 with pigments of the red, green, blue colors, for example.

Next, a method of driving the electrophoretic display device according to this embodiment will be described with reference to FIGS. 5 to 7. Hereinafter, among the plurality of pixel electrodes 21 arranged in the display unit 3, the pixel electrodes 21 of the pixels 20 to be displayed with the black color are referred to as pixel electrodes 21B and the pixel electrodes 21 of the pixels 20 to be displayed with the white color are referred to as pixel electrodes 21W.

Figure 5:
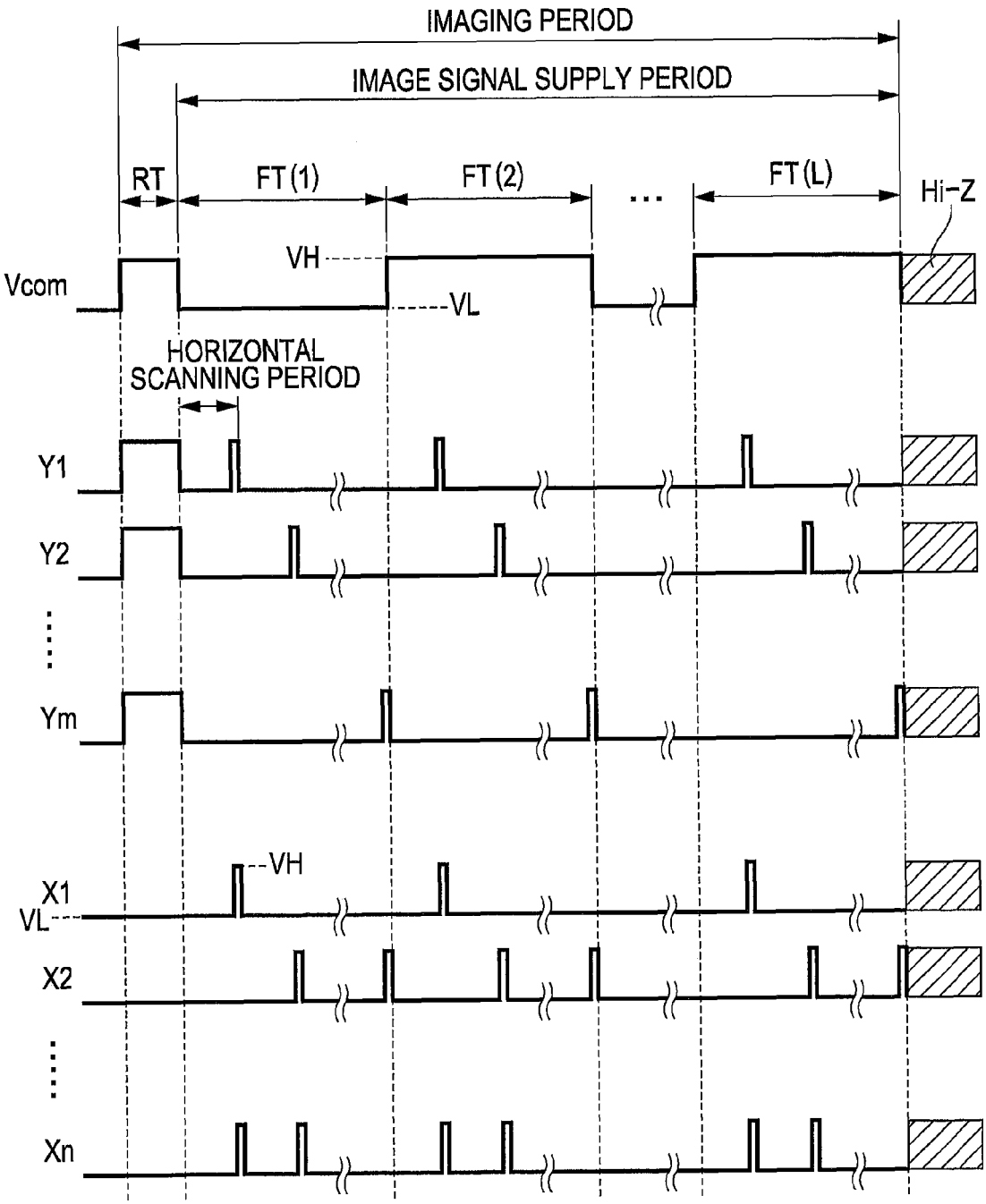
FIG. 5 is a timing chart illustrating a method of driving the electrophoretic display device according to the first embodiment.
Figure 6:
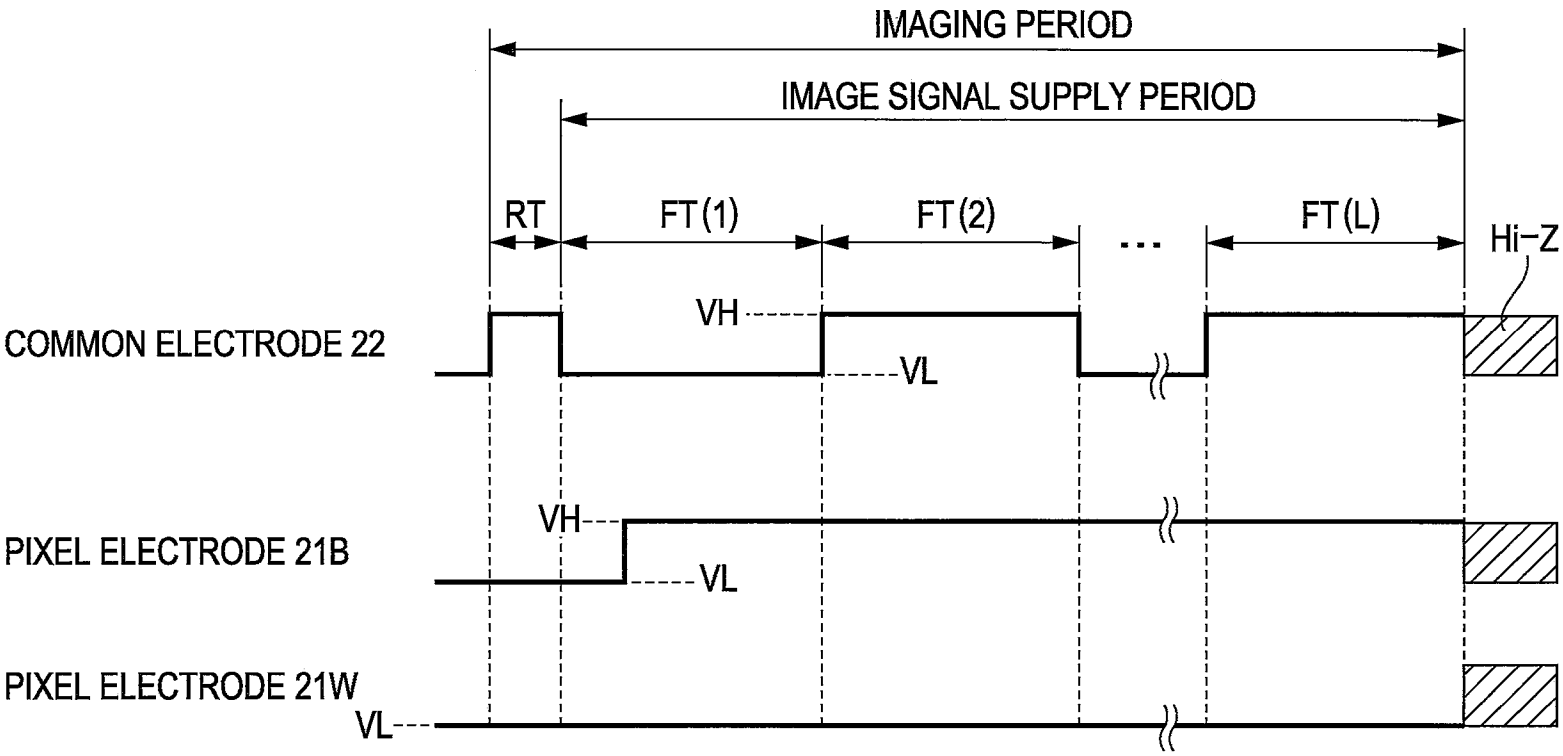
FIG. 6 is a timing chart illustrating the method of driving the electrophoretic display device according to the first embodiment.
Figure 7A:
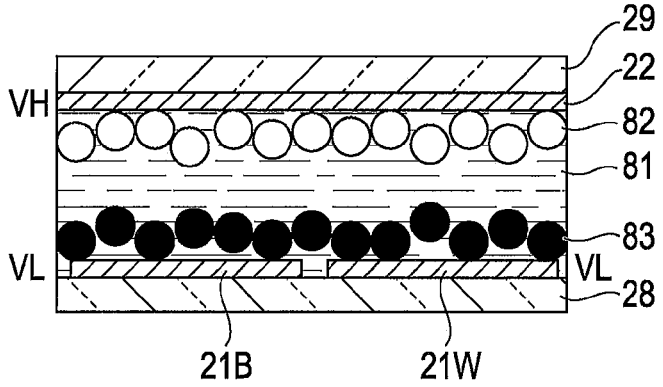
FIGS. 7A to 7D are schematic diagrams illustrating the states of electrophoretic particles when the electrophoretic display device is driven according to the first embodiment.
Figure 7B:
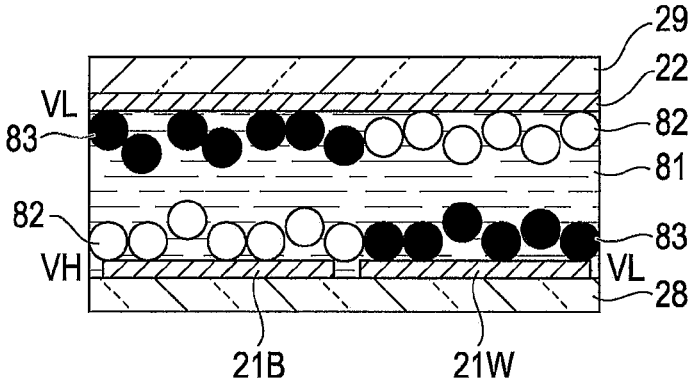
Figure 7C:
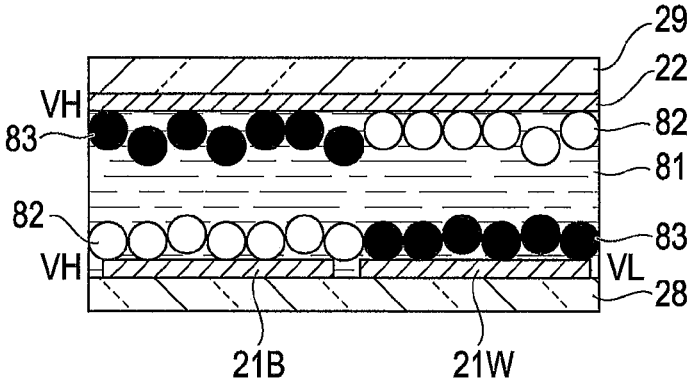
Figure 7D:
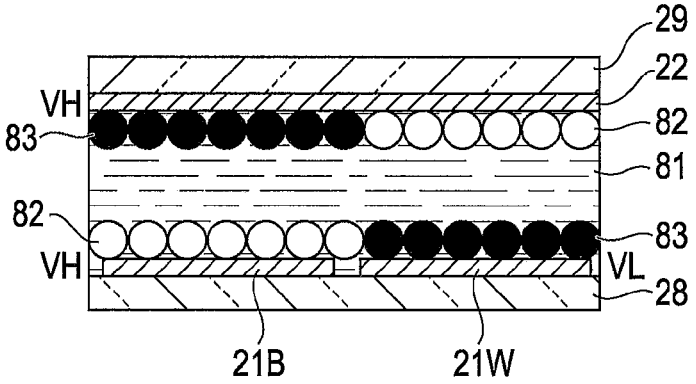

FIGS. 5 and 6 are timing charts illustrating the method of driving the electrophoretic display device according to this embodiment. In FIG. 5, time-dependent variation in the common potential Vcom, the potentials of the scanning lines Y1, Y2, . . . , and Ym, and the potentials of the data lines X1, x2, . . . , and Xn in an imaging period is shown (that is, a period in which a new image is prepared or written to the plurality of pixels 20 arranged in the display unit 3). In FIG. 6, time-dependent variation in the potential of the common electrode 22, the potential of the pixel electrodes 21B, the potential of the pixel electrodes 21W in the imaging period is shown. FIGS. 7A to 7D are schematic diagrams illustrating the states of the electrophoretic particles upon driving the electrophoretic display device according to this embodiment. FIG. 7A shows the state of the electrophoretic particles immediately after a reset period. FIG. 7B shows the state of the electrophoretic particles immediately after a first frame period. FIG. 7C shows the state of the electrophoretic particles immediately after a second frame period. FIG. 7D shows the state of the electrophoretic particles immediately after the imaging period.

As shown in FIG. 5, a reset operation of displaying the white color on the display surface of the display unit 3 in a reset period RT before an image signal supply period (which is a period in which the image signal is supplied to the pixels 20) in the imaging period is first performed.

That is, as shown in FIGS. 5 and 6, in the reset period RT, the scanning line driving circuit 60 (see FIG. 1) supplies the high potential VH to all the m scanning lines 40 (that is, the scanning lines Y1, Y2, . . . , and Ym) and the data line driving circuit 70 supplies the low potential VL to all the n data lines 50 (that is, the data lines X1, X2, . . . , and Xm). In this way, the low potential VL supplied to the data lines 50 is supplied to the pixel electrodes 21 of the pixels 20 via the pixel switching transistors 24 which are turned ON by the high potential VH supplied through the scanning lines 40. Accordingly, in the reset period RT, the pixel electrodes 21 (all the pixel electrodes 21B and the pixel electrodes 21W) of the pixels 20 are maintained in the low potential VL (see FIG. 6). On the other hand, in the reset period RT, the common potential supply circuit 220 (see FIG. 1) supplies the high potential VH as the common potential Vcom to the common potential lines 93. Accordingly, in the reset period RT, the common electrode 22 is maintained in the high potential VH (see FIG. 6).

As shown in FIG. 7A, in the reset period RT, the black particles 83 charged to the positive polarity are attracted toward the pixel electrodes 21 in the dispersion medium 81 by the Coulomb force and the white particles 82 charged to the negative polarity are attracted toward the common electrode 22 in the dispersion medium 81 by the Coulomb force. As a result, the white color is displayed on the display surface of the display unit 3.

As shown in FIG. 5, the image signal is supplied to the pixels 20 in the image signal supply period followed after the reset period RT in the imaging period. In this embodiment, the image signal supply period is set to as period which is L (where L is a natural number of 2 or more) times of the frame period or a vertical scanning period (that is, which is set in advance as a period for supplying the scanning signal sequentially to all the m scanning lines 40). The image signal supply period contains a first frame period FT(1), a second frame period FT(2), . . . , and an L frame period FT(L) in this order. In addition, each of the frame periods may be set to one in the range of 10 ms to 400 ms, for example.

Specifically, in the first frame period FT(1) in the image signal supply period, the scanning line driving circuit 60 sequentially supplies the pulse scanning signal to the scanning lines Y1, Y2, . . . , and Ym in every horizontal scanning period, and the data line driving circuit 70 supplies the image signal having the high potential VH (for example, 15 V) or the low potential VL (for example, 0 V) to the data lines X1, X2, . . . , and Xn at timing according to the scanning signal. In the example shown in FIG. 5, in the first frame period FT(1), the image signal having the high potential VH is supplied to the data lines X1 and Xn and the image signal having the low potential VL is also supplied to the data line X2 (in other words, the data line X2 is constantly maintained in the low potential VL) in initial horizontal scanning period at timing at which the pulse scanning signal is supplied to the scanning line Y1; the image signal having the high potential VH is supplied to the data lines X2 and Xn and the image signal having the low potential VL is also supplied to the data line X1 in the next horizontal scanning period at timing at which the pulse scanning signal is supplied to the scanning line Y2; and the image signal having the high potential VH is supplied to the data line X2 and the image signal having the low potential VL is also supplied to the data lines X1 and Xn in an m-th horizontal scanning period at timing at which the pulse scanning signal is supplied to the scanning line Ym. That is, in accordance with an image to be displayed, the image signal having the high potential VH is supplied to the pixel electrodes 21B of the pixel 20 to be displayed with the black color and the image signal having the low potential VL is also supplied to the pixel electrodes 21W of the pixels 20 to be displayed with the white color.

As shown in FIG. 6, the pixel electrodes 21B is constantly maintained in the high potential VH thanks to the potential held by the retention capacitors 27 until the supply of the next image signal having the high potential VH at least in the second frame period FT(2) described below, even when the image signal having the high potential VH is supplied at the timing at which the pulse scanning signal is supplied to the scanning lines 40.

On the other hand, as shown in FIGS. 5 and 6, the common potential supply circuit 220 (see FIG. 1) supplies the low potential VL as the common potential Vcom to the common potential lines 93 in the first frame period FT(1). Accordingly, in the first frame period FT(1), the common electrode 22 is constantly maintained in the low potential VL (see FIG. 6).

As shown in FIG. 7B, in the first frame period FT(1), the black particles 83 charged to the positive polarity are attracted toward to the common electrode 22 in the dispersion medium 81 by the Coulomb force and the white particles 82 charged to the negative polarity are attracted toward the pixel electrodes 21B in the dispersion medium 81 by the Coulomb force between the common electrode 22 constantly maintained in the low potential VL and the pixel electrodes 21B constantly maintained in the high potential VH. On the other hand, in the first frame period FT(1) neither the white particles 82 nor the black particles 83 are acted by the Coulomb force, since there is no potential difference between the common electrode 22 constantly maintained in the low potential VL and the pixel electrodes 21W constantly maintained in the high potential VL.

Next, as shown in FIG. 5, in the second period FT(2) followed after the first frame period FT(1), the scanning line driving circuit 60 sequentially supplies the pulse scanning signal to the scanning lines Y1, Y2, . . . , and Ym in every horizontal scanning period, and the data line driving circuit 70 supplies the image signal having the high potential VH or the low potential VL to the data lines X1, X2, . . . , and Xn at timing according to the scanning signal. In this embodiment, the data line driving circuit 70 supplies the image signal associated with an image to be equally displayed in each of the first frame period FT(1), the second frame period FT(2), . . . , and the L frame period FT(L) in the image signal supply period. Accordingly, in the second frame period FT(2), the same image signal as the image signal in the first frame period FT(1) is supplied. That is, in the second frame period FT(2), the same image signal as the image signal in the first frame period FT(1) is written to the pixel electrodes 21 and the retention capacitors 27.

As shown in FIG. 6, in the second frame period FT(2), the pixel electrodes 21B are constantly maintained in the high potential VH and the pixel electrodes 21W are constantly maintained in the low potential VL. In this embodiment, since the image signal associated with the image to be equally displayed is supplied to the pixel electrodes 21 in each of the first frame period FT(1), the second frame period FT(2), . . . , and the L frame period FT(L), the pixel electrodes 21B are constantly maintained in the high potential VH and the pixel electrodes 21W are constantly maintained in the low potential VL even in the third frame period FT(3), . . . , and the L frame period FT(L).

On the other hand, as shown in FIGS. 5 and 6, the common potential supply circuit 220 (see FIG. 1) supplies the high potential VH as the common potential Vcom to the common potential lines 93 in the second frame period FT(2). Accordingly, the common electrode 22 is constantly maintained in the high potential VH in the second frame period FT(2) (see FIG. 6).

As shown in FIG. 7C, in the second frame period FT(2), neither the white particles 82 nor the black particles 83 are acted by the Coulomb force, since there is no potential difference between the common electrode 22 constantly maintained in the high potential VH and the pixel electrodes 21B constantly maintained in the high potential VH. On the other hand, in the second frame period FT(2), between the common electrode 22 constantly maintained in the high potential VH and the pixel electrodes 21W constantly maintained in the low potential VL, the white particles 82 charged to the negative polarity are attracted toward the common electrode 22 in the dispersion medium 81 by the Coulomb force and the black particles 83 charged to the positive polarity are attracted toward the pixel electrodes 21W in the dispersion medium 81 by the Coulomb force.

In FIGS. 5 and 6, the driving in the first frame period FT(1) is also performed in the third frame period FT(3) followed after the second frame period FT(2). Accordingly, like the driving in the first frame period FT(1) described with reference to FIG. 7B, in the third frame period FT(3), between the common electrode 22 constantly maintained in the low potential VL and the pixel electrodes 21B constantly maintained in the high potential VH, the black particles 83 charged to the positive polarity are attracted toward the common electrode 22 by the Coulomb force and the white particles 82 charged to the negative polarity are attracted toward to the pixel electrodes 21B by the Coulomb force. On the other hand, neither the white particles 82 nor the black particles 83 are acted by the Coulomb force between the common electrode 22 constantly maintained in the low potential VL and the pixel electrodes 21W constantly maintained in the low potential VL.

The driving in the first frame period FT(1) is performed in the fifth frame period FT(5), the seventh frame period FT(7), etc. (that is, odd-numbered frame periods from an initial odd frame period in the image signal supply period).

In FIGS. 5 and 6, the driving in the second frame period FT(2) is also performed in the fourth frame period FT(4) followed after the third frame period FT(3). Accordingly, like the driving in the second frame period FT(2) described above with reference to FIG. 7C, in the fourth frame period FT(4), neither the white particles 82 nor the black particles 83 are acted by the Coulomb force between the common electrode 22 constantly maintained in the high potential VH and the pixel electrodes 21B constantly maintained in the high potential VH. On the other hand, between the common electrode 22 constantly maintained in the high potential VH and the pixel electrodes 21W constantly maintained in the low potential VL, the white particles 82 charged to the negative polarity are attracted toward the common electrode 22 by the Coulomb force and the black particles 83 charged to the positive polarity are attracted toward the pixel electrodes 21W by the Coulomb force.

The driving in the second frame period FT(2) is also performed in the sixth frame period FT(6), the eighth frame period FT(8), etc. (even-numbered frame periods from an initial even frame period in the image signal supply period).

In this way, in the image signal supply period, the voltage according to the image signal is repeatedly applied in an alternative manner between the common electrode 22 and the pixel electrodes 21B and between the common electrode 22 and the pixel electrodes 21W. That is, in the odd-numbered frame period such as the first frame period FT(1) and the third frame period FT(3), the voltage is applied between the common electrode 22 constantly maintained in the low potential VL and the pixel electrodes 21B constantly maintained in the high potential VH, and no voltage is applied between the common electrode 22 constantly maintained in the low potential VL and the pixel electrodes 21W constantly maintained in the low potential VL. On the other hand, in the even-numbered frame period such as the second frame period FT(2) and the fourth frame period FT(4), no voltage is applied between the common electrode 22 constantly maintained in the high potential VH and the pixel electrodes 21B constantly maintained in the high potential VH, and the voltage is applied between the common electrode 22 constantly maintained in the high potential VH and the pixel electrodes 21W constantly maintained in the low potential VL.

Accordingly, in the image signal supply period, the white particles 82 and the black particles 83 are surely moved between the common electrode 22 and the pixel electrodes 21. That is, it is possible to surely move one of each white particle 82 charged to the negative polarity and each black particle 83 charged to the positive polarity toward the pixel electrode 21 in the dispersion medium 81 and surely move the other thereof toward the common electrode 22 in the dispersion medium 81.

In this embodiment, the voltage according to the same image signal is applied repeatedly several times between the common electrode 22 and the pixel electrodes 21 in a unit of the frame period in the image signal supply period. Therefore, it is possible to surely attract the white particles 82 and the black particles 83 toward the common electrode 22 and the pixel electrodes 21 while preventing the white particles 82 and the black particles 83 from sinking and rising due to the convection currents of the dispersion medium 81 and the gravity action. That is, the voltage according to the same image signal is repeatedly applied between the common electrode 22 and the pixel electrodes 21B in the odd-numbered frame period (the first frame period FT(1), the third frame period FT(3), etc.) in the image signal supply period (see FIG. 7B). Moreover, the voltage according to the same image signal is repeatedly applied between the common electrode 22 and the pixel electrodes 21W in the even-numbered frame period (the second frame period FT(2), the fourth frame period FT(4), etc.) in the image signal supply period (see FIG. 7C). Accordingly, it is possible to surely attract the white particles 82 and the black particles 83 toward the common electrode 22 and the pixel electrodes 21 when the image signal supply period ends (that is, immediately after the L frame period), as shown in FIG. 7D.

According to the electrophoretic display device 1 described in this embodiment, the voltage according to the same image signal is applied repeatedly several times between the common electrode 22 and the pixel electrodes 21 in a unit of the frame period in the image signal supply period, even when a period holding the image signal is relatively shorter in the pixel electrodes 21 and the retention capacitors 28 due to a relatively small capacity value of the retention capacitors 28. Accordingly, it is possible to surely attract the white particles 82 and the black particles 83 toward the common electrode 22 and the pixel electrodes 21.

As a result, according to the electrophoretic display device 1 described in this embodiment, it is possible to display a high-quality clear image while reducing irregularity in color or brightness between pixels.

In FIGS. 5 and 6, after the imaging period, the common electrode 22 and the pixel electrodes 21 (in addition to the common potential lines 93, the scanning lines 40, and the data lines 50) become a high-impedance state (Hi-Z), that is, an electrically disconnected state. In this way, it is possible to prevent leak current between the pixel electrodes 21 adjacent to each other from occurring. Moreover, by suppressing power consumption, it is possible to surely hold the image signal in each of the pixels.

In this embodiment, the reset period RT is provided, but the reset period RT may not be provided.

Figure 8:
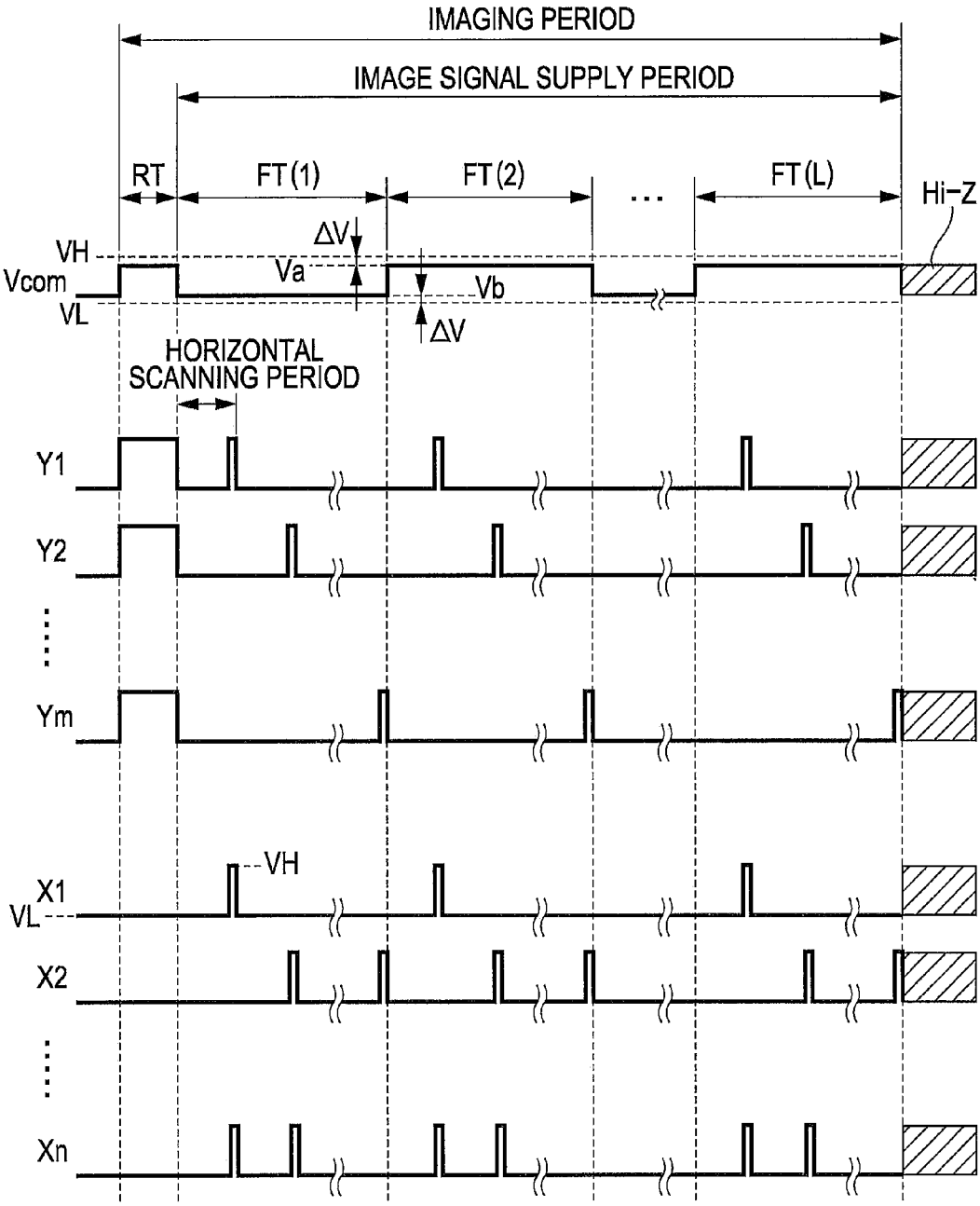
FIG. 8 is timing chart illustrating a modified example of FIG. 5.

FIG. 8 is a timing chart illustrating a modified example of the driving method in FIG. 5.

As the modified example, as shown in FIG. 8, the common potential Vcom is switched into a high potential Va lower by a potential difference ΔV than the high potential VH of the image signal and a low potential Vb by a potential difference ΔV than the low potential VL of the image signal, and the high potential Va and the low potential Vb are supplied to the common electrode 22. For example, when the high potential VH and the low potential VL are 15 V and 0 V, respectively, the high voltage Va and the low potential Vb are set to 14.5 V and 0.5 V (that is, the differential ΔV is set to 0.5 V).

Even in this case, it is possible to surely move the white particles 82 and the black particles 83 toward the pixel electrodes 21 and the common electrode 22.

In the odd-numbered frame period (the first frame period FT(1), the third frame period FT(3), etc.) in the image signal supply period, the potential of 0.5 V is added to the common electrode 22. Therefore, even when the potential of the retention capacitors 28 is lowered, the white particles 82 charged to the negative polarity can be held in the common electrode 22 thanks to the fact that the potential of the common electrode 22 is higher by 0.5 V than the pixel electrodes 21W which is in the low potential VL. Accordingly, it is possible to prevent the white particles 82 and the black particles 83 from migrating toward an opposite side (moving backward).

Likewise, in the even-numbered frame period (the second frame period FT(2), the fourth frame period FT(4), etc.) in the image signal supply period, the potential the common electrode 22 is lowered by 0.5 V than the high potential VH. Therefore, even when the potential of the retention capacitors 28 is lowered, the black particles 83 charged to the positive polarity can be held in the common electrode 22 thanks to the fact that the potential of the common electrode 22 is lower by 0.5 V than that of the pixel electrodes 21B which is in the high potential VH. Accordingly, it is possible to prevent the white particles 82 and the black particles 83 from moving backward.

Electronic Apparatus

Next, an electronic apparatus to which the electrophoretic display device described above is applied will be described with reference to FIGS. 9 and 10. Hereinafter, examples in which the electrophoretic display device is applied to an electronic paper and an electronic note will be described.

Figure 9:
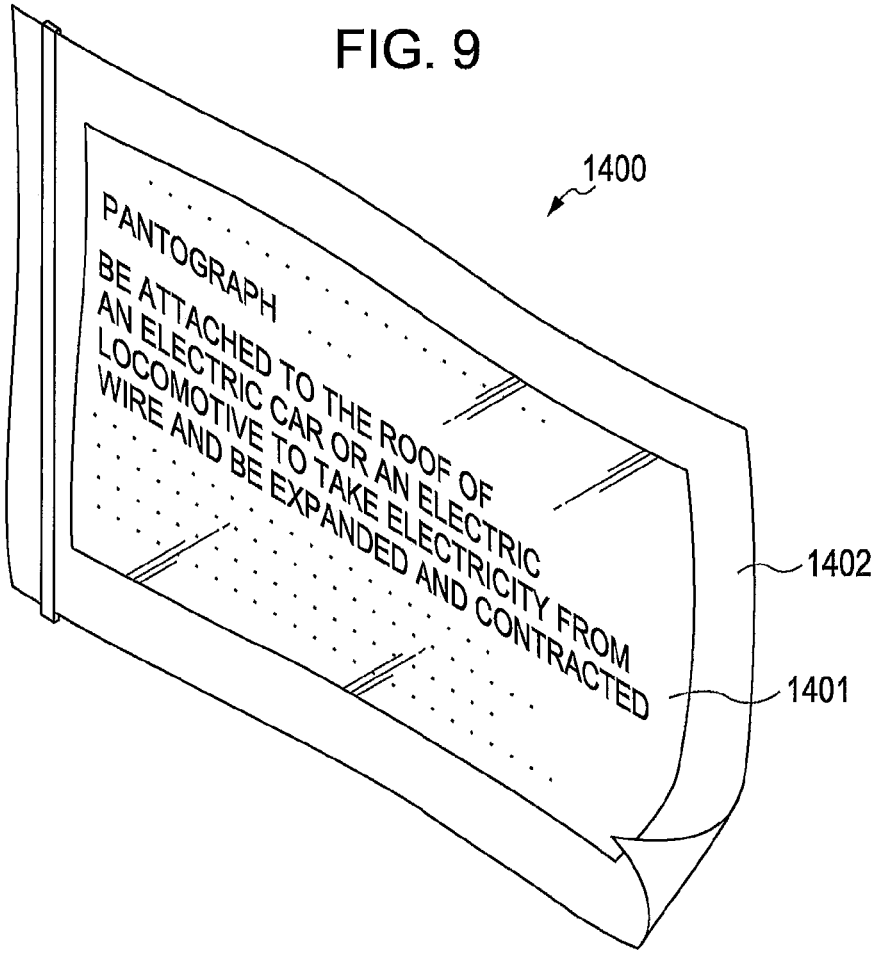
FIG. 9 is a perspective view illustrating the configuration of an electronic paper which is an example of an electronic apparatus using the electrophoretic display device.

FIG. 9 is a perspective view illustrating the configuration of an electronic paper 1400.

As shown in FIG. 9, the electronic paper 1400 includes the electrophoretic display device according to the above-described embodiment as a display unit 1401. The electronic paper 1400 has a flexible property and includes a main body 1402 formed of a rewritable sheet having texture like paper and flexibility.

Figure 10:
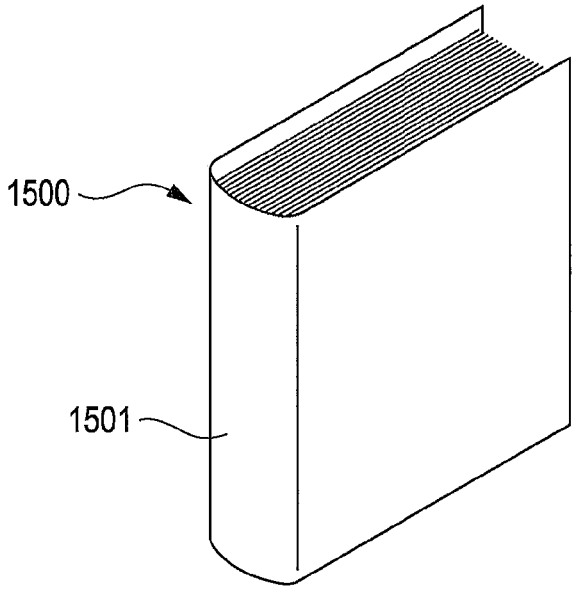
FIG. 10 is a perspective view illustrating the configuration of an electronic book which is an example of the electronic apparatus using the electrophoretic display device.

FIG. 10 is a perspective view illustrating the configuration of an electronic note 1500.

As shown in FIG. 10, the electronic note 1500 has a configuration in which plural sheets of electronic papers 1400 shown in FIG. 10 are bound and inserted into a cover 1501. The cover 1501 includes a display data input unit (not shown) for inputting display data supplied from an external device. Accordingly, the display details can be changed or updated on the basis of the display data with the electronic paper bound.

Since the electronic paper 1400 and the electronic note 1500 described above include the electrophoretic display device according to the above-described embodiment, it is possible to realize low power consumption and a high quality image display.

The electrophoretic display device according to the above-described embodiment can be applied to a display unit of an electronic apparatus such as a wrist watch, a cellular phone, or a portable audio apparatus in addition to the electronic paper and the electronic note.

The invention is not limited to the above-described embodiment, but may be modified in various forms without departing the gist or idea of the invention understood from the accompanying claims and the entire specification. A modified electrophoretic display device, a method of driving the modified electrophoretic display device, and an electronic apparatus including the modified electrophoretic display device are included in the technical scope of the invention.

The entire disclosure of Japanese Patent Application No. 2008-014605, filed Jan. 25, 2008 is expressly incorporated by reference herein.

What is claimed is:

1. An electrophoretic display device comprising:

a pair of first and second substrates;

an electrophoretic element which is interposed between the first and second substrates and includes a dispersion medium containing electrophoretic particles;

a plurality of pixel electrodes which are formed on the first substrate;

a common electrode which is formed opposite the plurality of pixel electrodes on the second substrate;

an image signal supply unit which supplies an image signal having a first potential or a second potential lower than the first potential to the plurality of pixel electrodes in accordance with image data;

a common potential supply unit which supplies a common potential to the common electrode, and a plurality of scanning lines, wherein the image signal supply unit supplies the image signal to the plurality of pixel electrodes in each of a predetermined number of frame periods in an image signal supply period containing the predetermined number of frame periods in accordance with the image data, the image signal supplied in each of the predetermined number of frame periods within the image signal supply period representing the same image, and wherein each frame period is a vertical scanning period over which a scanning signal is supplied sequentially to all of the plurality of scanning lines, and wherein the common potential supply unit switches the common potential once per frame period alternately between a third potential lower than the first potential and higher than the second potential and a fourth potential lower than the third potential and higher than the second potential, and supplies the switched potentials to the common electrode in each of the frame periods in the image signal supply period.

2. The electrophoretic display device according to claim 1, further comprising: on the first substrate, data lines which intersect with the plurality of the scanning lines;

transistors which are formed in correspondence to intersection of the data lines and the scanning lines and electrically connected to the pixel electrodes; and retention capacitors which are electrically connected between the transistors and the pixel electrodes and temporarily hold the image signal, wherein the image signal supply unit supplies the image signal to the pixel electrodes through the data lines and the scanning lines.

3. An electronic apparatus comprising the electrophoretic display device according to claim 1.

4. A method of driving an electrophoretic display device including a pair of first and second substrates, an electrophoretic element which is interposed between the first and second substrates and includes a dispersion medium containing electrophoretic particles, a plurality of pixel electrodes which are formed on the first substrate, a common electrode which is formed opposite the plurality of pixel electrodes on the second substrate, an image signal supply unit which supplies an image signal having a first potential or a second potential lower than the first potential to the plurality of pixel electrodes in accordance with image data, a common potential supply unit which supplies a common potential to the common electrode, and a plurality of scanning lines, the method comprising:

supplying the image signal to the plurality of pixel electrodes in accordance with the image data in each of a predetermined number of frame periods in an image signal supply period containing the predetermined number of frame periods by the image signal supply unit, the image signal supplied in each of the predetermined number of frame periods within the image signal supply period representing the same image, each frame period being a vertical scanning period over which a scanning signal is supplied sequentially to all of the plurality of scanning lines; and switching the common potential once per frame period alternately between a third potential lower than the first potential and higher than the second potential and a fourth potential lower than the third potential and higher than the second potential, and supplying the switched potentials to the common electrode in each of the frame periods in the image signal supply period by the common potential supply unit.

* * * * *